US006926557B1

(12) United States Patent
Yamaguchi et al.

(10) Patent No.: US 6,926,557 B1
(45) **Date of Patent: *Aug. 9, 2005**

(54) SHIELDED CONNECTOR OF REDUCED-SIZE WITH IMPROVED RETENTION CHARACTERISTICS

(75) Inventors: Tomisaburo Yamaguchi, Kanagawa (JP); Asakawa Tetsuya, Tokyo (JP)

(73) Assignee: Molex Incorporated, Lisle, IL (US)

( * ) Notice: Subject to any disclaimer, the term of this patent is extended or adjusted under 35 U.S.C. 154(b) by 485 days.

This patent is subject to a terminal disclaimer.

(21) Appl. No.: 09/660,888

(22) Filed: Sep. 13, 2000

(30) Foreign Application Priority Data

Sep. 16, 1999 (JP) ..... 11-262411

(51) Int. Cl.[7] ..... H01R 13/648
(52) U.S. Cl. ..... 439/607
(58) Field of Search ..... 439/607, 609, 439/101, 108

(56) References Cited

U.S. PATENT DOCUMENTS 5,993,258 A * 11/1999 Matsunuma et al. ..... 439/607
6,077,120 A * 6/2000 Futatsugi et al. ..... 439/607
6,086,421 A * 7/2000 Wu et al. ..... 439/607
6,095,869 A * 8/2000 Wang ..... 439/676

* cited by examiner

*Primary Examiner*—P. Austin Bradley
*Assistant Examiner*—Felix O. Figueroa
(74) *Attorney, Agent, or Firm*—Thomas D. Paulius

(57) ABSTRACT

A reduced weight and size shielded receptacle connector includes an internal insulative connector housing having top and bottom walls, without any sidewalls interconnecting the top and bottom walls together. A plurality of conductive terminals are supported within the connector. A receptacle portion of the connector is formed in cooperation with the top and bottom walls of the connector housing and with a pair of metal sidewalls formed by bending a shield member around parts of the connector housing. A metal retaining shield is provided that also overlies a portion of the connector housing and which is partially retained on the connector housing by the metal shell. The shield not only provides shielding, but also serves to retain the opposing connector in mating engagement with receptacle connector by way of three retention members that extend in and engaged the opposing connector in three different directions.

20 Claims, 7 Drawing Sheets

FIG. 3
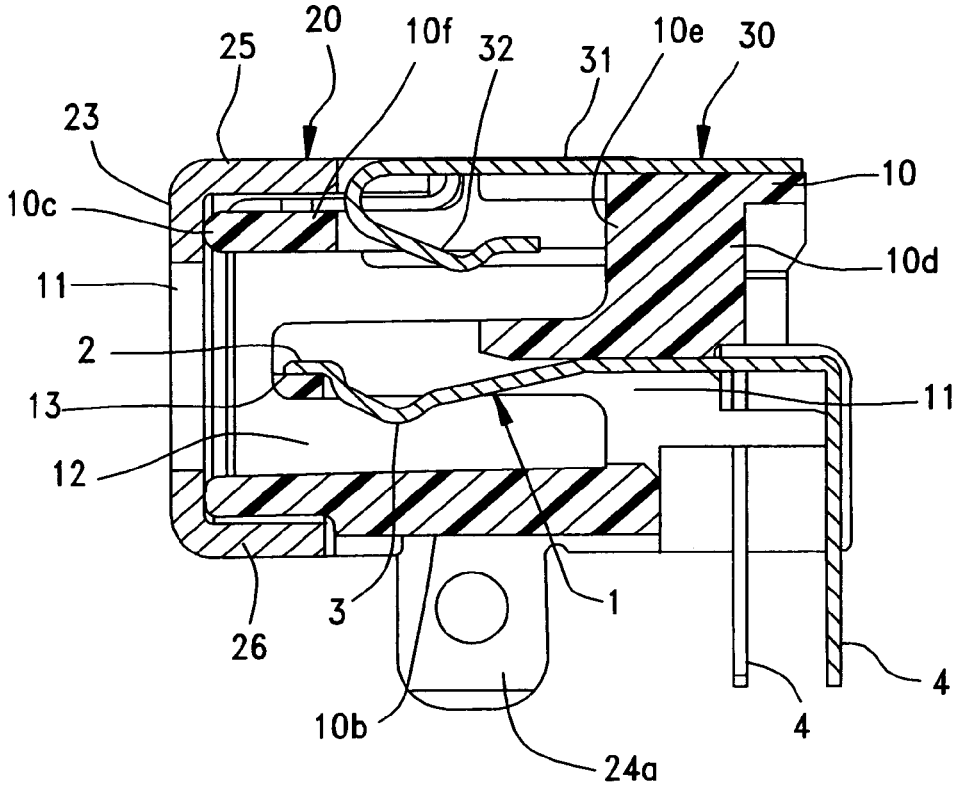
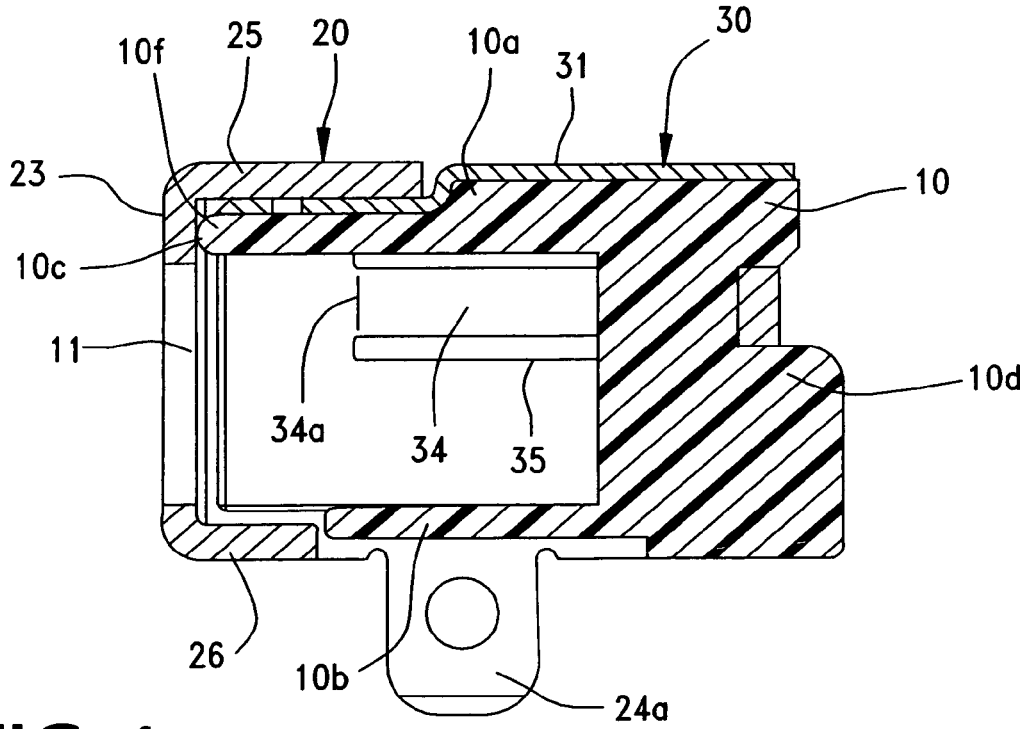
FIG. 4

FIG. 14
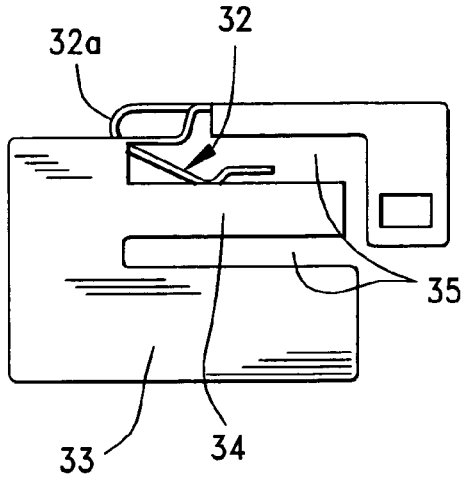
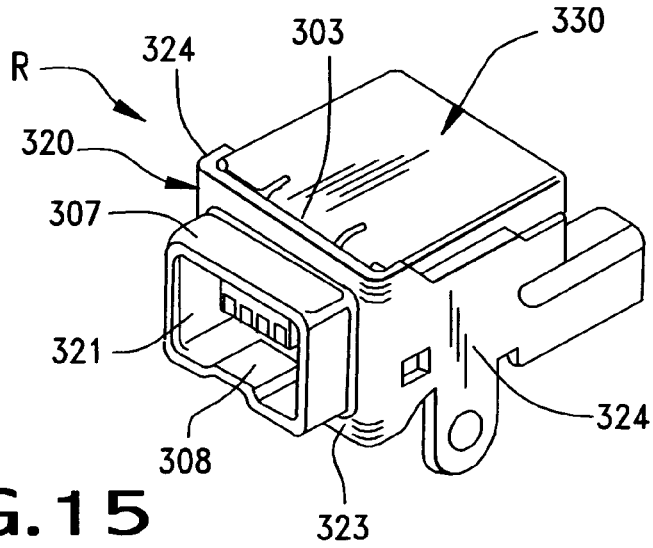
FIG. 15
(PRIOR ART)
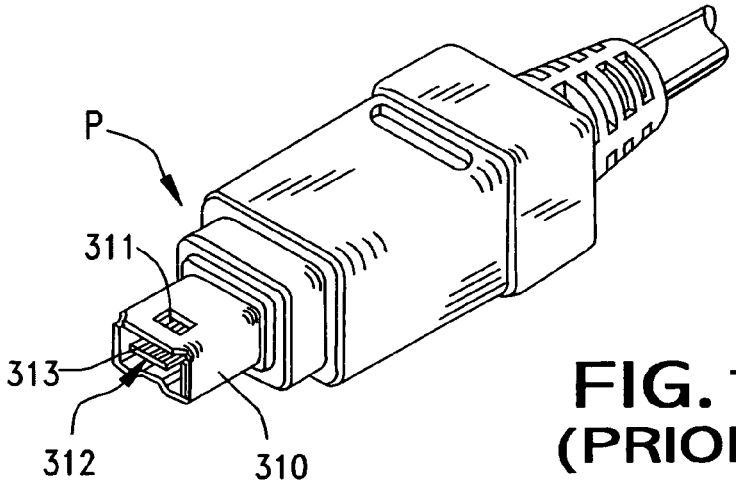
FIG. 16
(PRIOR ART)

SHIELDED CONNECTOR OF REDUCED-SIZE WITH IMPROVED RETENTION CHARACTERISTICS

BACKGROUND OF THE INVENTION

The present invention relates generally to shielded connectors, and more particularly to small-sized connectors having improved opposing connector retention characteristics.

It is known that metal shields may be disposed on the exterior circumferential surface of box-shaped insulative housings of connectors for the purposes of preventing interference, such as electrical noise. One example of such a connector is disclosed in Japanese Utility Model Application Laid-Open No. Hei 5-34679, Japanese Patent Application Laid-Open No. Hei 10-83866, and others. The connector disclosed in these publications is one that is mounted to a substrate such as a printed circuit board and is formed so that a pair of substantially U-shaped shield members made of metal plates are overlapped on four or three surfaces of the exterior of a substantially box-shaped insulative connector housing.

FIGS. 15 and 16 of this application show such a conventional shielded connector. FIG. 15 illustrates a receptacle style connector R, while FIG. 16 illustrates a plug style connector P. The receptacle connector R is typically smaller in size than the plug connector P, so it should be understood that the drawings are not to scale and that the representative size of the receptacle connector R has been enlarged for clarity.

As for the receptacle connector R of FIG. 15, the shield of the connector is composed of a metal shell 320 that is disposed on the outer surface of the connector housing. It is shaped in a substantially U-shape as viewed from the top and the connector shield also includes a metal shield plate 330 that is U-shaped in cross-section that is disposed between the metal shell 320 and the connector insulative housing. The metal shell 320 is formed so as to cover three surfaces, i.e., the front surface and both side surfaces of the insulative housing, while the shield metal plate 330 is disposed to cover three surfaces, i.e., the top surface and both side surfaces of the insulating housing. Thus four surfaces of the connector housing are actually covered with the shield, i.e., the front surface, the top surface and both side surfaces. An engagement piece 303 is provided on the metal shield plate 320 that is engaged with an engagement recess portion 311 of a terminal portion 310 that serves as a metal shield for opposing the plug connector P.

The metal shell 320 has a front surface shield portion 323 and side surface shield portions 324 on both sides of the connector. An engagement sleeve portion 307 has an opening 321 into which the terminal portion 310 of the plug connector P is inserted, and is provided in the front surface 323 of the shield portion. As illustrated, the engagement sleeve portion 307 is formed substantially into a rectangular sleeve shape so that it projects outwardly on the front surface of the connector. This metal shell 320 is typically formed by drawing that specific portion of the engagement sleeve portion 307, after the entire metal shield plate has been stamped out from a blank. A convex portion 308 may be formed as a polarizing portion that is engaged with a recess 312. Conductive terminals 313, having contact portions are arranged within the plug connector P.

Connectors such as those shown in FIGS. 15 & 16 tend to be small in size, as well as the circuit boards upon which they are mounted. However, it is desirable to reduce the manufacturing cost of such connectors without losing the dimensional stability of the connector. Thus, it is a goal of this invention to keep the connector small in size while maintaining the dimensional stability of the shield and retaining its electrical properties.

However, in the prior art connectors described above and shown in FIGS. 15 & 16, there is a problem. The manufacturing cost of these connectors is high because the engagement sleeve portion 307 is formed by drawing. The outer profile of these connectors is also increased because of this drawn structure, resulting in difficulty in achieving the goal of miniaturization. The engagement sleeve portion 307 is formed by drawing so that there is a problem that the sleeve portion 307 does not have satisfactory dimensional stability. Furthermore, a large force, such as a twisting force, may be applied to the engagement sleeve portion 307 when engaged with the plug connector P. The forces generated by repeated removal and insertion may weaken the drawn portions of the connector.

Also, in these type of connectors, it has been found that there is room for improvement by reducing the connector size and the overall weight of the connector, while still maintaining the electrical performance of the shield. The conventional connector housing used with such connectors is formed substantially into a box-like shape with six surfaces. In view of the inherent function of the insulative housing, it is sufficient to have the housing to support the shield member in its extent around the housing and its internal contacts, as well as supporting the contacts. In the aforementioned conventional connectors, although the housing has structure supports the metal shield and has a desired mechanical strength, it has an unnecessarily large thickness for its structural stability. This creates a problem that inhibits the goal of attaining further miniaturization and weight reduction.

Additionally, in this type of connector where repeated removal and insertion of the plug connector P to the receptacle connector R occurs, frictional wear or deformation can occur with the drawn engagement portions, so that there is a fear that the contact stability between the shield members of the plug and receptacle connectors is gradually reduced over time, and frictional wear may result in a displacement between in the two respectively engaged shields, reducing the mechanical stability of the two connectors. For this reason, depending on the frequency and condition of the insertion/removal of the two connectors, there is another fear that either the grounding stability of the overall connector system will be degraded (i.e., the ability of electrical noise to be led by the shields to a ground on the circuit board) as well as the stability of the engagement between the two connectors.

In particular, with respect to the grounding stability problem, due to the displacement between the two shields, there is a fear that the electrical connection between the plug connector and the receptacle connector is unstable and it will be difficult to lead the electrically transmitted noise components to the ground on the circuit board.

It is also possible to form the shields of the connectors by way of die-casting, instead of the drawn members shown. However, the ductility of such die-cast parts is poor as compared to sheet metal and in these size and style connectors, a high precision for engagement desired. In the reduced size, excessive stresses may develop during insertion and removal of the connectors, so that a fear of deforming the drawn or die-cast shield engagement members is real.

The present invention is directed to an improved connector that overcomes the aforementioned disadvantages.

SUMMARY OF THE INVENTION

It is therefore a general object of the present invention is to provide a shielded connector that is reduced in size and in weight, particularly on the receptacle side of the connector, and which is further durable suitable for repeated use in insertion and removal cycles, thereby giving a reliable connection to an opposing plug connector, yet being stable during engagement of the two connectors and being effective in shielding the contacts of the connector from electrical noise when connected to an opposing plug connector.

Another object of the present invention is to provide a reduced size receptacle connector of the USB type for mounting on a circuit board, the connector having a connector body having top and bottom walls extending horizontally therefrom, but without having any sidewalls, the top and bottom walls cooperating with side pieces of a metal shell overlying the connector housing to define an internal cavity of the connector that engages with an opposing plug connector.

Yet another object of the present invention is to provide a reduced size and weight USB style connector in which the connector includes a housing formed from electrically insulative material, the connector housing having a body portion that supports a plurality of conductive terminals thereon, the connector housing further including top and bottom walls extending forwardly from the housing body portion in a cantilevered fashion, and the connector housing not having any vertical sidewalls for joining the top and bottom walls together, the connector further including a conductive metal shell encircling most of the exterior surface of the connector body, the shell including a top plate, a front plate and two side plates that are formed around the top and bottom plates and the connector body, the metal shell side plates defining the sidewalls of the receptacle of the connector and the metal shell retaining a separate metal shield member in place upon the connector housing.

Yet still another object of the present invention is to provide a reduced size connector for mounting to a circuit board, the connector having a reduced size by virtue of its structure which includes an insulative inner housing portion that includes top and bottom walls cantilevered from a body portion, the top and bottom walls defining the top and bottom extends of a plug-receiving receptacle, the connector housing includes a shield component mounted thereon that includes side pieces that extend between the top and bottom walls of the connector housing and which, with the top and bottom walls, cooperatively define a receptacle of the connector.

The present invention accomplishes these and other objects by way of its novel and unique structure, utilizing the following means to solve the aforementioned problems. A first means of the present invention is characterized by way of a shielded connector having an insulative housing supporting at least one conductive terminal, and a shield member that overlies a surface of the connector housing, the shield member having a metal shell with a frame portion for surrounding an opening of the housing in which at least one conductive terminal is disposed, and a metal shield disposed between the metal shell and the connector housing, wherein the connector housing is formed without sidewalls, but retains a top wall, a bottom wall and an intermediate contact support that project longitudinally through the connector housing, the open sidewall portions of the connector housing being covered by portions of the shield member.

With this particular means, the sidewalls of the connector housing may be eliminated, and thus it is possible to attain both of the goals of miniaturization of the connector and weight reduction of the connector insofar as the eliminated sidewalls are concerned. Also, because both of the opened sidewalls of the connector housing are covered by the shield member, it is possible to maintain both sufficient shield performance of the entire connector, and also maintain the desired mechanical strength of the connector.

A second means of the present invention is characterized by the metal shield which has a top surface shield portion for covering the top surface of the connector housing, two side surface shield portions for covering both open sides of the connector housing, and spring portions for holding the receptacle connector together in engagement with a plug connector, the spring portions having left and right side surfaces facing inwardly of the connector and in opposition to sides of the opposing plug connector.

With this second means, the spring portions are provided on the side surface shield portions and because the connector housing has no sidewalls, the spring portions may be brought into contact with the opposing left and right side surfaces of the plug connector to thereby will hold the plug connector effectively in a stable condition, without any rattling or displacement. Thus, the electrical connection effected by the connector is stable in a manner in which any transmitted electrical noise is passed directly to the ground located on the circuit board to which the receptacle connector is mounted. The spring portions are brought into contact with the side surfaces of the opposing plug connector, so that resistance due to friction between the spring portions and the side surfaces of the plug connector is sufficient to maintain the two connectors engaged together. The stability that occurs during insertion and removal of the two connectors is enhanced due to this frictional resistance caused by the spring pieces.

A third means of the present invention is characterized in that another engagement piece is provided on the top of the receptacle connector that engages with a recessed portion of the surface of the opposing plug connector. This third engagement piece is guided into the insulating housing of the connector through an opening that is formed in the top plate portion of the connector housing. According to this means, the engagement piece is provided on the top surface shield portion of the metal shield so that it will engage the recessed portion of the surface of the plug connector to hold the plug connector in place within the receptacle connector. In addition to the positioning of the opposing connector caused by the left and right side spring pieces, this engagement piece provides a further positioning along the top face of the plug connector to hold the plug connector in place within the receptacle connector. The three engagement pieces exert a force on the plug connector in three directions, so that the stability of the connector during repeated insertion and removal is enhanced, as well as the electrical connection between the plug and receptacle connectors. The top plate portion of the connector housing is formed with an opening for receiving the engagement piece within the confines of the connector housing, so that this opening further contributes to the weight reduction obtained with the present invention.

A fourth means of the present invention is characterized in that the engagement piece of the connector is received within a recess formed in the shield of the insertion end of the opposing connector when the opposing connector is inserted into the opening of the connectors of the present invention. According to this fourth means, it is possible to prevent accidental disengagement of the two connectors. Additionally the stability of the engagement between the two pieces is enhanced.

These and other objects, features and advantages of the present invention will be clearly understood through consideration of the following detailed description.

BRIEF DESCRIPTION OF THE DRAWINGS

FIG. 3 is a sectional view of the connector of FIG. 2, taken along lines 3—3 thereof;

FIG. 4 is a sectional view of the connector of FIG. 2, taken along lines 4—4 thereof;

FIG. 14 is a side view, taken from the right, of the metal shield of FIG. 11;

FIG. 15 is a perspective view of a prior art shielded receptacle connector: and, FIG. 16 is a perspective view of a prior art shielded plug connector.

DETAILED DESCRIPTION OF THE PREFERRED EMBODIMENTS

Figure 1:
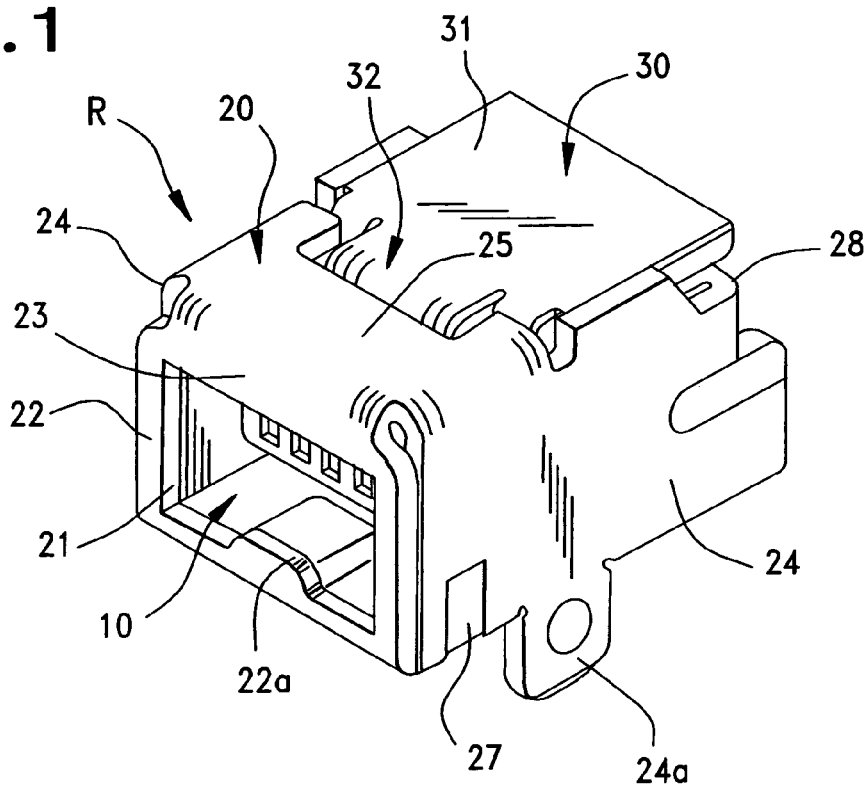
FIG. 1 is a perspective view of a receptacle connector for mounting on a circuit board which is constructed in accordance with the principles of the present invention.
Figure 2:
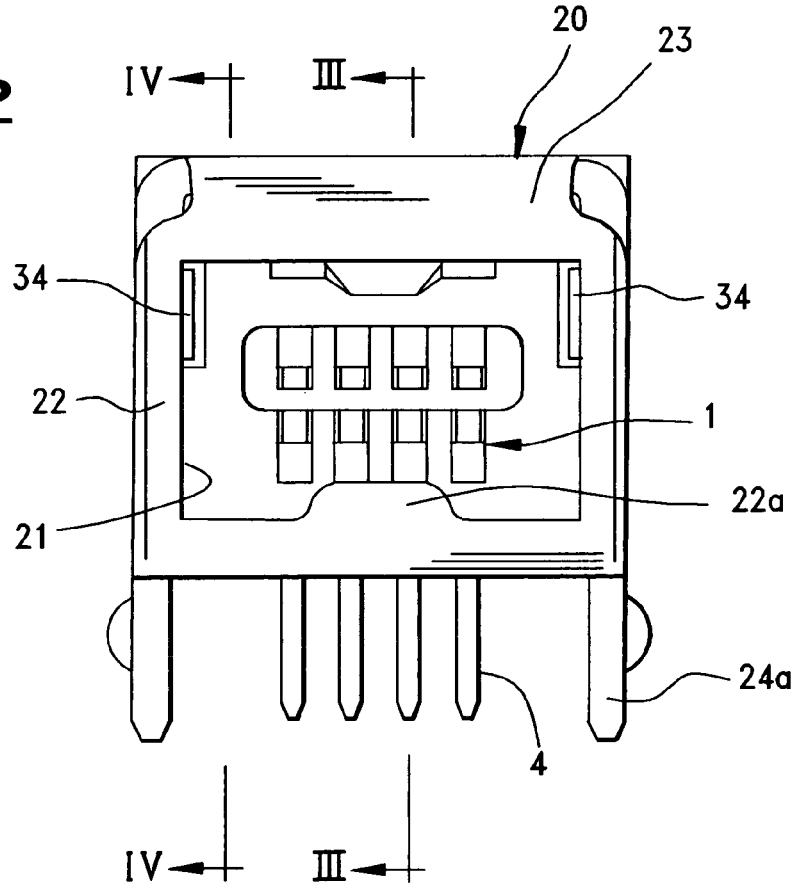
FIG. 2 is a front end view of the connector of FIG. 1.
Figure 5:
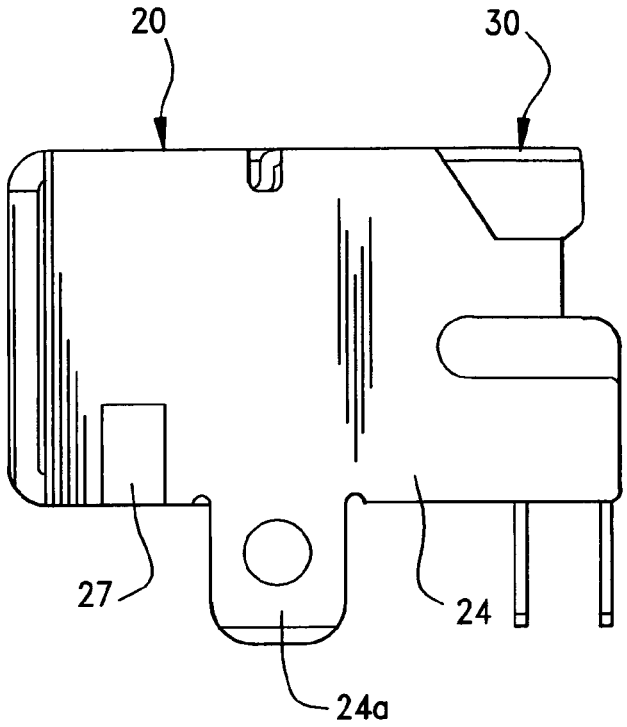
FIG. 5 is a side view of the connector of FIG. 1.
Figure 6:
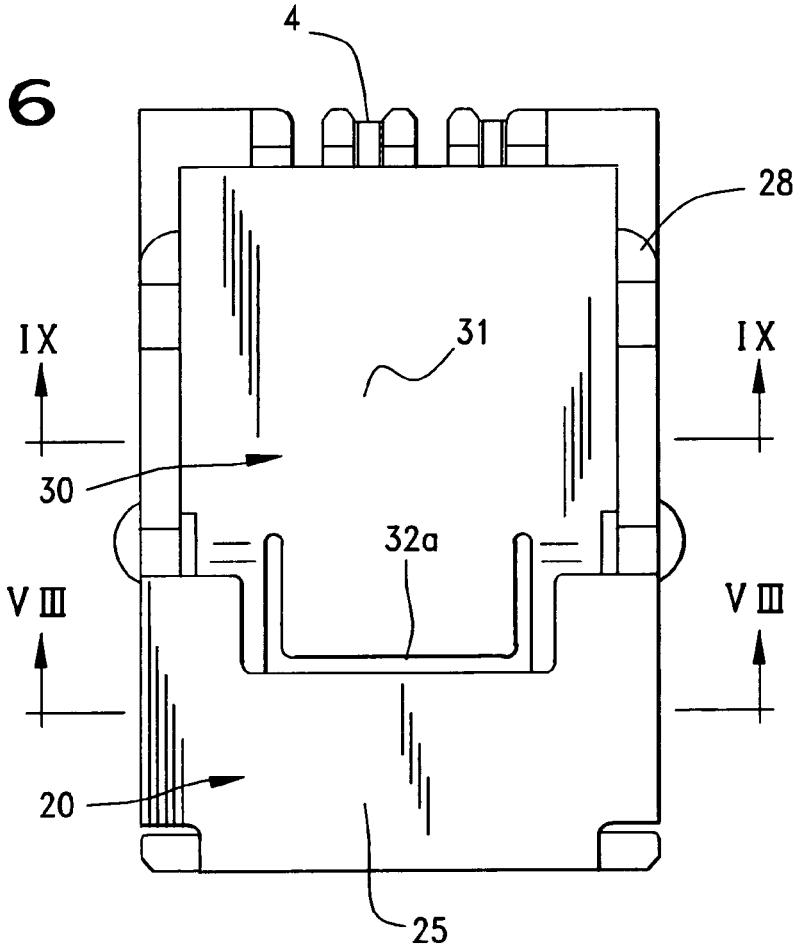
FIG. 6 is a top plan view of the connector of FIG. 1.
Figure 7:
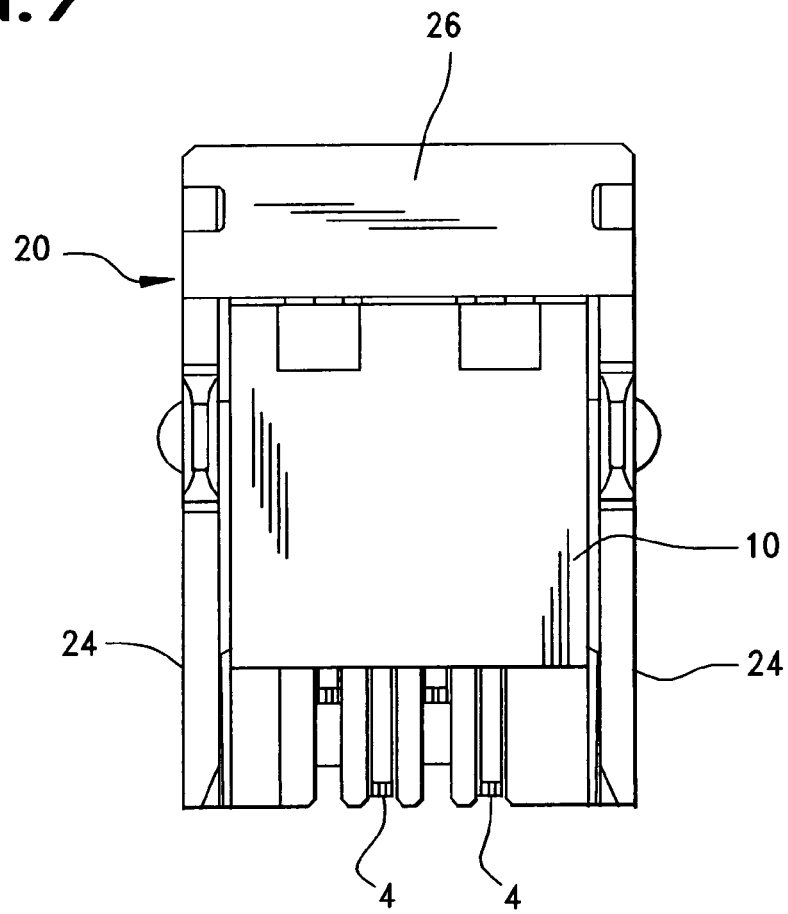
FIG. 7 is a bottom plan view of the connector of FIG. 1.

An improved shielded connector R constructed in accordance with the principles of the present invention is illustrated in FIGS. 1–14 and in the embodiment shown, a "DIP" (Dual-In-line Process) type electrical connector of USB (Universal Serial Bus) style is illustrated as an example of a connector to which the principles of the present invention may be applied. The connector shown is one that is intended to be mounted on a substrate, such as a circuit board (not shown). As illustrated in FIGS. 1–3, the shielded connector R is provided with an inner insulated housing for supporting one or more conductive terminals or contacts 1, and a metal shell 20 for overlying the outer surface of the connector housing to thereby shield the terminal 1. The metal shell 20 includes a front frame panel portion 22 that defines an opening 21 in the shell 20 and the connector R. This opening 21 receives a portion of an opposing plug connector P, such as the one shown in FIG. 16. The front frame portion 22 can be seen to entirely surround the opening 21.

The front frame portion 22 is formed as a single, seamless piece and it surrounds the entire extent, or circumference, of the opening 21 of the connector R. The front frame portion 22 may include, if desired, a convex portion 22*a* that has a profile greater than that of the frame, i.e., is larger than it, so as to form a polarizing feature at the opening 21 that mates with a corresponding recessed portion of the opposing plug connector P. The opposing plug connector P will be substantially the same in size and detail as that shown in FIG. 16, so that it is not necessary to reproduce it here.

Figure 8:
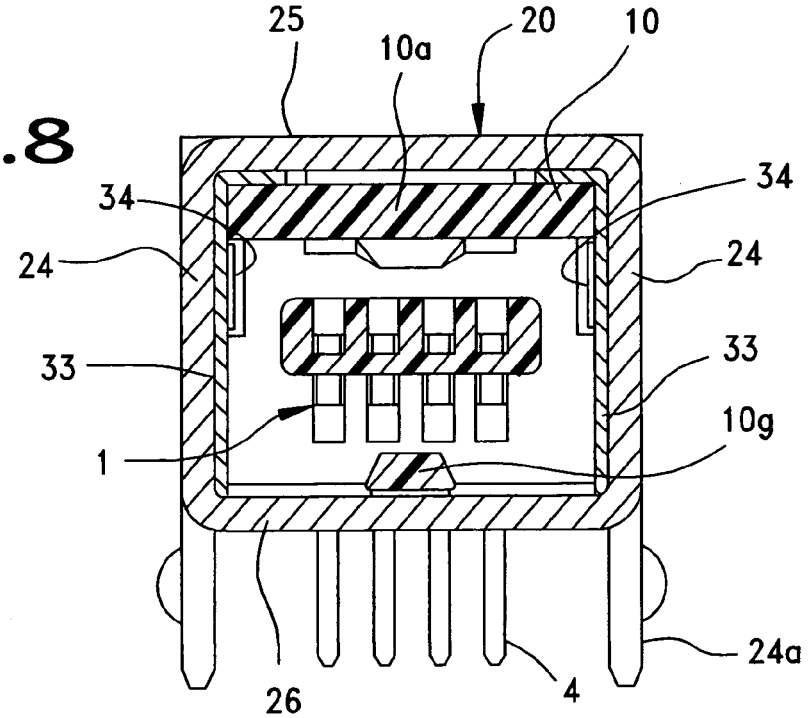
FIG. 8 is a sectional view of the connector of FIG. 6, taken along lines 8—8 thereof.
Figure 9:
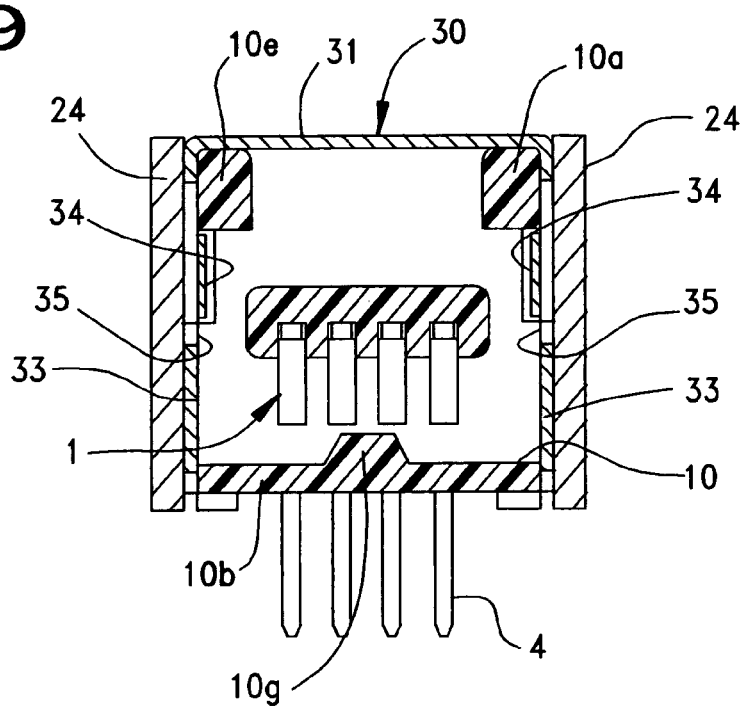
FIG. 9 is a sectional view of the connector of FIG. 6, taken along lines 9—9 thereof.

The insulative housing 10 of the connector has a box-like shape with a plurality of openings. The housing 10 is preferably formed by molding from a resin or plastic that possesses a high mechanical strength. As can be seen from FIGS. 3, 4 8 and 9, the connector housing 10 has a top plate, or wall portion, 10*a* that forms a part of its top surface, a bottom plate, or wall portion, 10*b* that forms a part of the bottom surface of the connector housing, a front surface, or wall portion, 10*c* with an insertion opening 21 formed therein for receiving a leading portion of the opposing plug connector P, and a rear body portion 10*d* having an extended opening 11*a* through which the conductive terminals 1 extend for connection to a circuit board (not shown). The top and bottom wall portions 10*a*, 10*b* are cantilevered out from the rear body portion 10*d*. These terminals 1 may include solder tails that may be surface mounted to the circuit board, or as illustrated, they may include the through-hole tails illustrated. Importantly, and as explained in greater detail below and as illustrated in FIGS. 8 & 9, the housing 10 is formed with out any sidewalls, or side plate portions. Rather, it has a general U-shape in cross-section, as shown in FIG. 4 with a terminal support wall portion 11 disposed between the top and bottom wall portions 10*a*, 10*b*. The terminal support wall portion 11 is also cantilevered from housing rear body portion 10*d*.

Turning now to FIG. 3, the housing 10 includes an opening 10*e* in its top surface that receives the engagement portion 32 of a metal shield 30 that is applied to the top plate portion 10*a* of the housing 10. This top plate portion 10*a* includes a front portion 10*c* (FIG. 3) that has a thin recessed portion 10*f* formed therein which approximately matches the thickness of the metal shell 20. This is because the metal shell 20 extends partially over the metal shield 30 and accordingly, the thickness of the top plate portion 10*a* is reduced so that the exterior surface of the metal shell 20 will be flush with the surface of the metal shield 30.

As mentioned above, no sidewalls are formed in the housing 10, and therefore as illustrated in FIG. 4 the top plate portion 10*a* and the bottom plate portion 10*b* of the housing 10 extend out from the rear body portion 10*d* of the housing 10 in a cantilevered fashion. For stability purposes, the housing rear body portion 10*d* preferably has a large thickness as compared to the plate portions for the purpose of enhancing the mechanical strength of the connector housing 10.

The connector housing 10 has a substantial box-like shape and is provided in its interior portion with an inner or central terminal support portion 11 that supports one or more conductive terminals 1 in the connector housing 10. The terminals are shown best in FIG. 3 and each terminal includes an extended, curved contact portion 3 formed along the body thereof and a tail portion 4 that extends out of the connector housing 10. The housing terminal support portion 11 has an opening that receives the terminal and includes a ledge or end portion 13 against which a free end 2 of the terminal 1 bears. The contact portion 3 of the terminal protrudes through the bottom of the terminal support portion 11 and extends into part 12 of the connector insertion opening. The curved contact portion 3 is formed near the free end 2 of the terminal 1, so that the spring effect that ensures good contact between the terminal 1 and a facing terminal of an opposing connector P is enhanced.

The tail portions 4 of the terminals 1 exit the housing 10 by way of a rear passage or port 11*a*, and may be bent downwardly to extend straight and project through the lower part of the connector housing 10. The tails 4 may extend straight as illustrated for insertion into a through hole formed in the circuit board to which the connector is mounted or they may be bent into a horizontal plane for soldering to contact pads on the circuit board. The receptacle connector R illustrated is shown as a four-pin connector having four terminals 1 arranged within the connector housing 10. In order to avoid bunching of the terminal tails 4, the tails are staggered as shown in FIG. 3. Other terminal arrangements and types are contemplated.

The metal shell 20 is formed after it is stamped out of a suitable metal blank by bending it. The metal blank 20A is illustrated in plan view in FIG. 10. It can be seen to include a plurality of panels that are integrally attached to each other, such as a front surface shield panel, or portion 23 indicated at 101, two side surface shield panels, or portions 24 on both sides of the front surface but spaced apart therefrom as indicated at 102, a top surface shield panel, or portion 25 as indicated by 103, a bottom surface shield portion 26 as indicated by 104, two engagement pieces 27 as indicated by 105, and fixing pieces 28 as indicated by 106. All these panels, portions and pieces form the part of the metal shell that overlies the outer surfaces of the connector housing 10. These overlying portions indicated by 101 to 106 are formed by bending them along the broken lines in FIG. 10. Thus, it will be understood that the metal shell 20 has what may be considered an overlapped structure where at least one portion overlies each of five of the six surfaces of the connector housing 10. Therefore the metal shell 20 has at least one portion that overlies each of these five surfaces of the connector housing that are all formed by way of bending or forming so that the metal shell 20 may be fixed readily and firmly to the connector housing 10.

Figure 10:
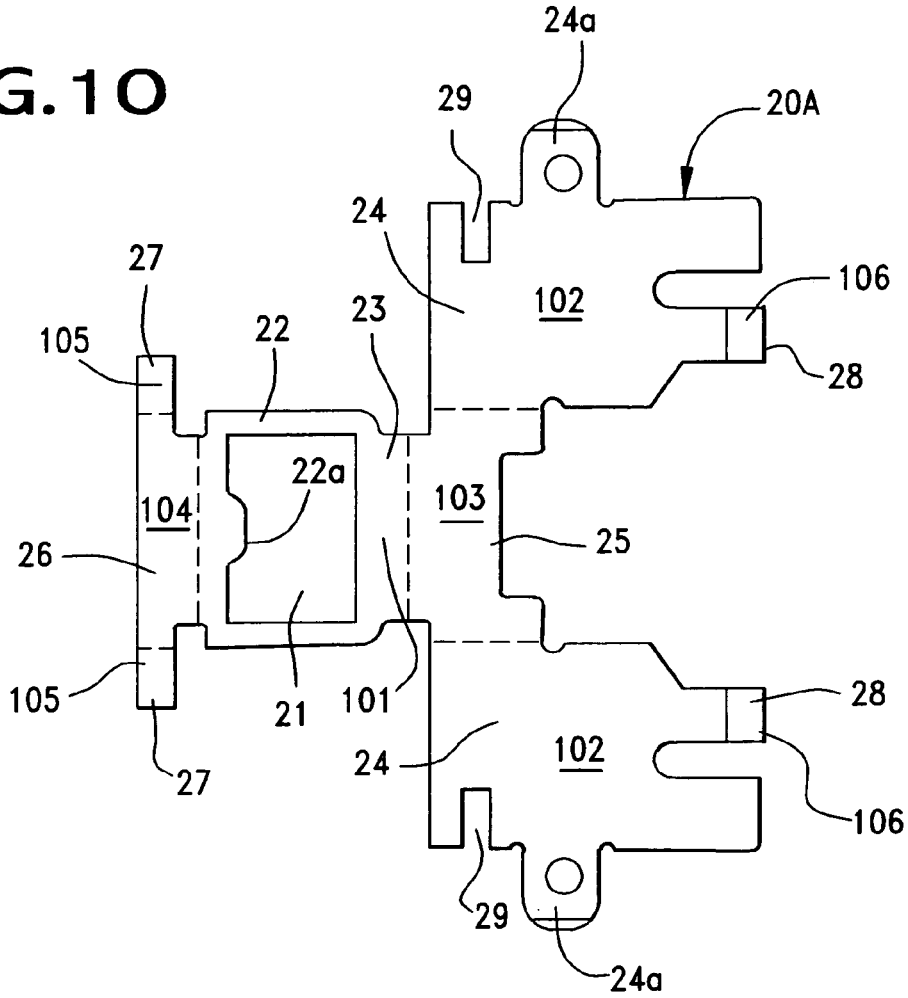
FIG. 10 is a plan view of a metal blank that is formed into the metal shell utilized on the connector of FIG. 1.

Joint portions (FIG. 1) of the shell 20 are formed during the bending of the metal shell 20 along the broken lines of FIG. 10. These joint portions include the engagement pieces 27 that are located on both sides of the connector housing 10 and which are received within corresponding complementary shaped cutaway openings 29 so that both the engagement pieces 27 and the sidewalls 24 of the metal shell 20 are flush with each other. As a result, these joints do not project outwardly on the exterior surface of the connector, as they would if they were drawn as in the prior art connectors discussed above. The cutaway openings 29 of the shell sidewalls 29 are preferably sized so as to accommodate the engagement pieces 27 as members of the same thickness. The metal shell 20 may also include tabs 24*a* that project from the metal shell 20 and which are received within slots formed on the circuit board, which will typically have contacts that lead directly to an earth or ground of the device in which the connector R is used.

Figure 11:
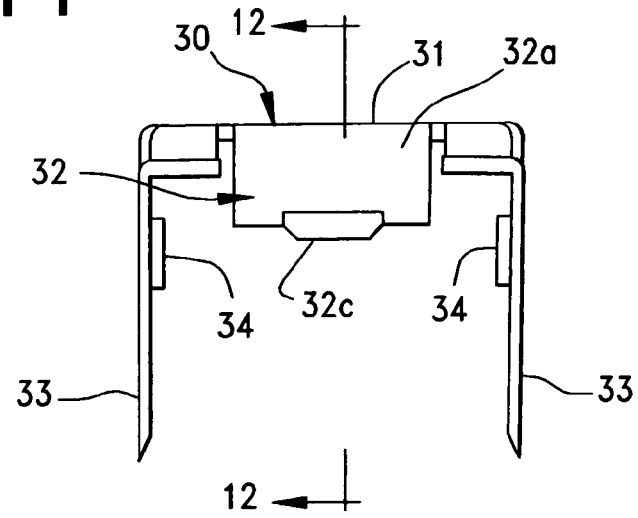
FIG. 11 is a front end view of the metal shield of FIG. 10 that is placed onto the connector housing of the connector of FIG. 1.
Figure 12:
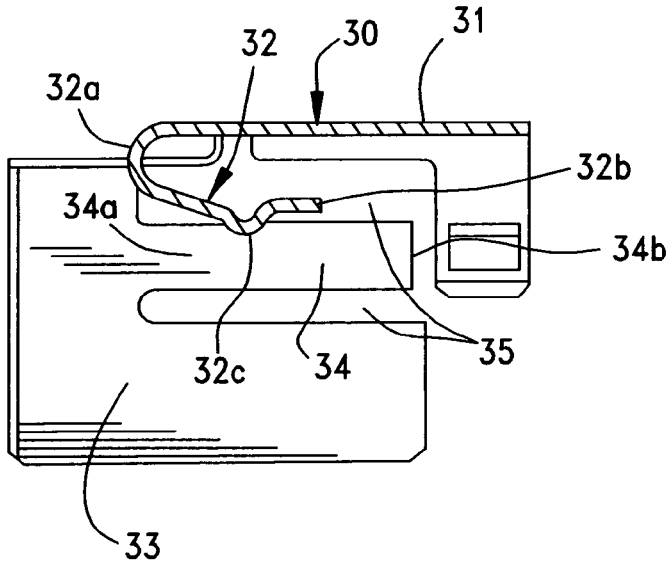
FIG. 12 is a sectional view of the metal shield of FIG. 1, taken along lines 12—12 thereof.
Figure 13:
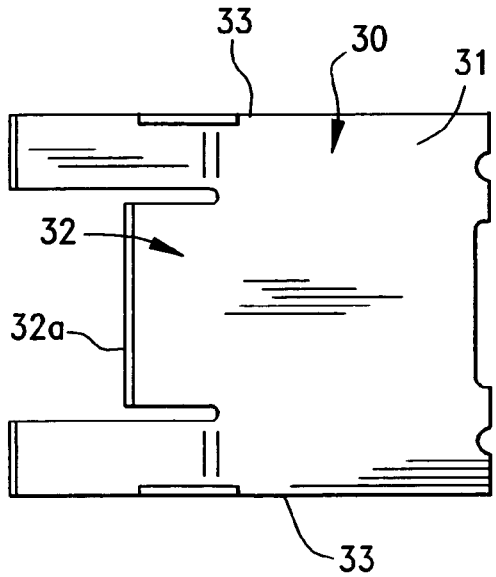
FIG. 13 is a top plan view of the metal shield of FIG. 11.

FIG. 1 illustrates the metal retainer shell 20 applied to the connector R after bending and with the metal shield 30, also applied to the connector housing 10. The metal shield 30 is also preferably stamped from a single metal blank and is bent into its desired shape in place on the connector R. The metal shield 30 is disposed between the insulative housing 10 and the metal shell 20 and is restricted in its place upon the housing 10 by the metal shell 20. FIG. 11 is a frontal elevational view of the metal shield, with a cross-sectional view of the shield being illustrated in FIG. 13 and a right side elevational view is shown in FIG. 14.

The metal shield 30 is formed into a U-shape as viewed from the front end thereof and it includes a top surface shield portion 31 that covers a part of the top surface of the connector housing 10. It also includes two side surface shield portions 33 that cover both of the open sides of the connector housing 10, and each of the side shield portions 33 include spring pieces 34 formed therewith. The metal shield further includes an engagement piece 32 that, as best illustrated in FIG. 3, projects to the interior of the metal shield 30 and the connector housing 10. This engagement piece is designed to interferingly contact an opposing recess 311 of a plug connector P as shown in FIG. 16.

Each of the spring pieces 34 functions to hold the opposing plug connector P in place with the receptacle connector opening 21, when the plug connector P is inserted into the receptacle connector R. These spring pieces 34 lie in opposition to the sides of the plug connector side walls 310. Each spring piece 34 takes the form of a plate with body portions 34*a* (FIG. 12) that are formed as part of the side surface shield portions 33 and with free end portions 34*b* that extend from the body portions 34*a*. The free end portions 34*b* extend on the sides of the rear surface of the connector housing along the side surface shield portions in opposition to the connector housing body portion. (FIG. 4.) Slots, or cutaways, 35 are preferably formed in both of the side surface shield portions 33 to engage outer projections formed on the connector housing to both hold the shield 30 in place on the connector housing, and also so that the spring pieces 34 may move freely from their associated side surface shield portions 33 to thereby act as a pair of spring engagement arms. In this regard, each of the spring pieces 34 projects slightly inwardly into the receptacle formed by the connector housing top and bottom wall portions and the sidewalls of the outer metal shell 20 along the order of a thickness of the metal blank from which the shield 30 is stamped. This inward projection is illustrated in FIG. 11. This projection is attained by bending the spring pieces 34 in the area of their body portions 34*a*. Each of the spring pieces 34 will lie along the inner wall of the metal shield and in the connector receptacle opening 21, into which the plug connector P is inserted. These two spring pieces 34 serve to exert a retaining pressure on the opposing plug connector P in the horizontal direction from both the left and right sides of the connector opening 21.

The metal shield 30 also has an engagement piece 32 that is formed therewith and which is bent inwardly at a front end 32*a* thereof so that a free end portion 32*b* of the engagement piece 32 extends through an opening of the connector housing 10. The engagement piece free end 32*b* also extends in opposition to the connector housing body portion 10. (FIG. 3.) The engagement piece 32 extends into the interior receptacle 21 of the connector housing through an opening, or window formed in the connector housing top wall member 10*a*. The free end 32 has a bent, and preferably convex portion 32*c* formed thereon having a profile that will engage with recessed, or open portions, 311 that is provided on the outer shell 310 of the plug connector P. See FIG. 16. This engagement piece 32 exerts a retaining force on the plug connector P in the vertical direction and along the top surface of the plug connector. As set out below, a rib portion 10 g having a profile similar to that of the portion 32*c* may be formed as part of the bottom wall member 10*b* of the connector housing 10. (FIG. 9.)

In this embodiment, the sidewalls of the connector housing 10 are omitted (i.e., open) so that the connector housing 10 itself may be reduced both in size and in weight. The window in the top wall member also assists in reducing weight of the connector R. This permits the connector to achieve the goal of significant reduction size and in weight to the point where connectors of the present invention may be made at one-third the size of comparable conventional connectors shown in FIG. 15. The overall mechanical strength of the connectors of the invention is not affected because the open sides of the connector housing 10 are covered by the side surface shield portions 24 of the metal shell 20 as well as the side surfaces 33 of the metal retainer shield 30, so that the electrical and mechanical performance of the connector is maintained.

The side surface portions 33 of the metal shield 30 and their associated spring pieces 34 are aligned with the open spaces between the top and bottom wall members of the connector housing so that these two spring pieces 34 extend into the receptacle opening 21 formed in the connector R so as to contact the side surfaces of the plug connector shell 310 of the opposing plug connector insertion end. Consequently, the shell 310 and the plug connector P are held in place within the receptacle connector R in a stable manner from the left and right sides thereof, without any displacement. Therefore, the electrical connection between the plug connector P and the receptacle connector R is maintained in a stable condition which makes it possible to effectively convey any transmitted electrical noise to the ground located in the circuit board by way of the receptacle shield 30 that is in contact with the metal shell 20 and its attachment legs 24.

The spring pieces 34 themselves contact the outer surface of the plug connector shell 310 and serve to stabilize the frictional resistance that occurs during insertion and removal of the plug connector P. These spring pieces 34 are disposed on the right and left sides of the connector housing 10 and clamp and hold the plug shell 310 on both right and left sides thereof, and as shown in FIG. 9, this clamping occurs at a level at or above the level of support for the contact portions 3 of the terminals 1. These two spring pieces enhance both the grounding aspect of the two connectors and the stability of the connector R during insertion and removal of the plug connector P therefrom.

Each spring piece 34 may take the form of a plate having a free end portion 34*a* extending toward the rear of the connector housing 10 and along the side surface shield portion 33. This both simplifies the manufacturing of the connector R but also reduces its manufacturing cost in that only simple machine work, such as bending, need be performed on the spring pieces 34 in a direction close to each other (i.e., inwardly, with respect to the connector receptacle 21) and thus it is possible to bring the pieces 34 into reliable contact with the outer surfaces of the plug connector shell 310. Because the spring pieces 34 are in the form of plates, it is possible to bring it into uniform contact with the outer surface of the plug connector outer shell 310. The free end portions 34*b* of each spring piece 34 extend rearwardly along the connector housing 10 in the insertion direction of the plug connector P, and thus do not interfere with the insertion of the plug connector P. Additionally, the spring pieces 34 and the engagement piece 32 exert a retention force on the insertion plug of the plug connector P, on three of the low sides of the insertion plug, which increases the mechanical and retention stability of the connector.

In the embodiment described, the forming of the metal shell 20 by stamping, does not weaken the exterior frame 22 or the receptacle opening 21 that receives the plug end of the plug connector P, so that the stability of the opening 21 is enhanced. Also, because the metal shell is stamped and formed rather than drawn and formed, the manufacturing cost is reduced. Furthermore, the elimination of the connector housing sidewalls and the use of the opening for the engagement piece cooperate to reduce the overall size of the connector. The frame portion 22 is stamped as a continuous extent of metal that surrounds the opening 21 and is formed without drawn or joint portions, so it will exhibit superior mechanical strength.

It will be understood that according to the present invention, it is possible to provide a shielded receptacle connector that is reduced in size and is reduced in weight that is durable for repeated use in insertion and removal cycles and which effectively performs its function of transmitting electrical noise to a ground on a circuit board.

While the preferred embodiment of the invention have been shown and described, it will be apparent to those skilled in the art that changes and modifications may be made therein without departing from the spirit of the invention, the scope of which is defined by the appended claims.

What is claimed is:

1. A connector for providing a connection between an opposing connector and a circuit board, the opposing connector having an elongated insertion end for mating with the connector, said connector comprising:

an insulative housing supporting a plurality of conductive terminals, the terminals each having contact portions and tail portions, the tail portions extending outwardly and away from the connector housing, the connector housing having a body portion and distinct top and bottom wall portions extending therefrom, the connector housing top and bottom portions being disposed on said body portion to define a space therebetween adapted to receive said opposing connector insertion portion therein, the contact portions of said terminals being disposed in said space and between said top and bottom wall portions, said connector housing not having any sidewalls interconnecting said top and bottom wall portions together such that said connector housing has a generally U-shaped cross-section;

a retainer comprising a metal shield that overlies a portion of said connector housing, the retainer shield having three distinct retention members formed thereon, each of the retention members extending at least partially into said space between said connector housing top and bottom wall portions for engaging opposing portions of said opposing connector inserted into said space, each of said retention members further extending into said space from three different directions; and an outer metal shell having a plurality of different panel portions, some of which overlie portions of said connector housing, the shell member having a front face panel that extends vertically between said connector housing top and bottom wall portions, two side panels that extend vertically between said connector housing top and bottom wall portions and close off said space therebetween to define a four sided receptacle of said connector, the front face panel having an opening formed therein that communicates with said receptacle, two of said retention members being disposed interiorly of said side panels and the third of said retention members being disposed interiorly of said connector housing top wall portion, the metal shield being disposed between the metal shell and the connector housing, the metal shield being retained in its place upon the housing by the metal shell.

2. The connector as set forth in claim 1, wherein each of said retention members includes a free end that extends into said space toward said connector housing body portion.

3. The connector as set forth in claim 1, wherein said connector housing top wall member includes an opening formed therein and said third retention member extends through said opening into said receptacle.

4. The connector as set forth in claim 1, wherein said shell include a bottom panel portion integrally formed with said front panel portion.

5. The connector as set forth in claim 4, wherein said shell includes a top panel portion integrally formed with said front panel portion, said top panel portion overlying part of said retainer shield and said connector housing top wall portion, said shell side panel portions being integrally formed with said panel front portion, said top and side panel portions being folded along side edges of said connector housing top wall portion.

6. The connector as set forth in claim 1, wherein said shell front panel portion has a frame portion that extends completely around said opening.

7. The connector as set forth in claim 5, wherein said shell includes a bottom panel portion integrally formed with said front panel portion.

8. The connector as set forth in claim 7, wherein said bottom panel portion and said side panel portions include cooperating engagement means.

9. The connector as set forth in claim 8, wherein said bottom panel portion includes a pair of engagement tabs extending outwardly therefrom and each of said side panel portions includes a slot sized to receive one of said engagement tabs, said engagement tabs being received within said side panel portion slots when folded around said connector housing.

10. The connector as set forth in claim 1, wherein said retainer shield is formed from a single metal blank having a top portion and two side portions each of which overlie respective opposing portions of said connector housing body portion, a first of said three retention members being formed as part of said retainer shield top portion and a second and third of said three retention members being formed as parts of said retainer shield side portions.

11. The connector as set forth in claim 10, wherein said retainer shield side portions each include a slot separating said second and third retention members therefrom.

12. The connector as set forth in claim 1, wherein one of said three retention members extends downwardly into said space to exert a vertical retention force on said opposing connector when inserted into said receptacle and the other two retention members extend sideways into said space to exert a horizontal retention force on said opposing connector when inserted into said receptacle.

13. The connector as set forth in claim 1, wherein a portion of said outer shell overlies a portion of said retainer shield.

14. The connector as set forth in claim 10, wherein said connector housing top wall portion includes an opening disposed therein that communicates with said receptacle and said first retention member extends through said opening into said space, said first retention member being bent upon itself and extending in said space toward said connector housing.

15. The connector as set forth in claim 1, wherein each of said retention members includes a free end that extends in opposition to said connector housing body portion.

16. A receptacle connector for providing electrical connection between an opposing plug connector with a circuit board, the opposing connector having an insertion end for mating with the receptacle of said connector, comprising:

an insulative housing, the connector housing supporting a plurality of conductive terminals, the connector housing having distinct top and bottom wall portions defining an interior receptacle in which said terminals are supported, the receptacle being sized to receive said plug connector insertion end when said plug connector is mated to said receptacle connector, the housing not having any sidewalls interconnecting the top and bottom wall portions together;

a retainer shield for shielding a portion of said connector housing and for engaging a plurality of exterior surfaces of said plug connector insertion end, the retainer shield including a body portion that is bent to overlie at least three distinct sides of said connector housing, said retainer shield further including at least two retention members formed therewith and projecting into said connector housing interior receptacle, said two retention members being oriented in distinct vertical and horizontal planes so as to exert a retaining force from two different directions on two different surfaces of said plug connector insertion end when inserted into said receptacle; and an outer shell member extending partially over the retainer shield, the retainer shield being retained in its place upon the housing by the outer shell member.

17. The connector of claim 16, wherein said retainer shield further includes a third retention member formed therewith and projecting into said connector housing interior receptacle, two of said three retention members being oriented to each apply a sideways retaining force on said plug connector insertion end, and the third of said three retention members being oriented to apply a retaining force on a top surface of said plug connector insertion end when inserted into said receptacle.

18. The connector of claim 16, wherein the outer shell member is disposed on the exterior of said connector housing, said outer shell member overlying at least four different surfaces of said connector housing and having a front panel portion with an opening formed therein that communicates with said connector housing interior receptacle.

19. The connector of claim 18, wherein said outer shell member overlies a portion of said retainer shield and at least partially retains said retainer shield in place on said connector housing.

20. A connector for providing a connection between an opposing connector and a circuit board, the opposing connector having an elongated insertion end for mating with the connector, said connector comprising:

an insulative housing supporting a plurality of conductive terminals, the connector housing having a body portion with distinct top and bottom wall portions extending therefrom, the connector housing top and bottom portions defining a receptacle therebetween adapted to receive said opposing connector insertion portion therein, said connector housing not having any sidewalls interconnecting said top and bottom wall portions and defining part of said receptacle;

a retainer shield that overlies a portion of said connector housing, the retainer shield being formed from metal blank and having three distinct retention members formed therewith, each of the retention members extending at least partially into said receptacle for engaging an opposing portion of said opposing connector inserted into said receptacle, each of said retention members further extending into said receptacle from three different directions; and, an outer metal shell having a plurality of different panel portions disposed on some portions of said connector housing in overlying relationship, the shell member having a front face panel that extends vertically between said connector housing top and bottom wall portions, two side panels that extend vertically between said connector top and bottom wall portions, the front face panel having an opening formed therein that communicates with said receptacle, two of said retention members being disposed interiorly of said outer shell side panels and the third of said retention members being disposed interiorly of said outer shell and said connector housing top wall portion, the outer metal shell extending partially over the retainer shield to retain the retainer shield in its place upon the housing.

* * * * *